US006499976B1

(12) United States Patent
McPhate et al.

(10) Patent No.: US 6,499,976 B1
(45) Date of Patent: Dec. 31, 2002

(54) DOWNHOLE ROLLER VANE MOTOR

(76) Inventors: Andrew J. McPhate, 6618 Highland Rd., Baton Rouge, LA (US) 70808; Matthew McPhate, 6618 Highland Rd., Baton Rouge, LA (US) 70808; Douglas R. Fleming, 236 Crystal St., New Orleans, LA (US) 70124

( * ) Notice: Subject to any disclaimer, the term of this patent is extended or adjusted under 35 U.S.C. 154(b) by 0 days.

(21) Appl. No.: 09/933,553

(22) Filed: Aug. 17, 2001

(51) Int. Cl.[7] ..... F03C 2/22
(52) U.S. Cl. ..... 418/13; 418/188; 418/225
(58) Field of Search ..... 418/188, 225; 175/107

(56) References Cited

U.S. PATENT DOCUMENTS

| | | | | | |
|---|---|---|---|---|---|
| 1,944,018 | A | * | 1/1934 | Thompson | 418/225 |
| 2,068,570 | A | | 1/1937 | Ross | 418/225 |
| 2,631,544 | A | | 3/1953 | Wilcox | 418/24 |
| 3,025,802 | A | | 3/1962 | Browne | 418/225 |
| 3,213,801 | A | | 10/1965 | Venygr | 418/225 |
| 3,247,803 | A | | 4/1966 | Halsey | 418/225 |
| 3,381,622 | A | | 5/1968 | Wilcox | 418/225 |
| 3,447,476 | A | * | 6/1969 | Farris | 418/225 |
| 3,877,442 | A | | 4/1975 | Miller, Jr. | 123/8.45 |
| 3,966,369 | A | * | 6/1976 | Garrison | 418/153 |
| 4,105,377 | A | | 8/1978 | Mayall | 418/173 |
| 5,030,071 | A | * | 7/1991 | Simpson | 418/13 |
| 5,733,113 | A | | 3/1998 | Grupping | 418/188 |
| 5,785,509 | A | | 7/1998 | Harris et al. | 418/11 |

FOREIGN PATENT DOCUMENTS

| | | | | |
|---|---|---|---|---|
| FR | 610.744 | | 9/1926 | |
| NL | 47795 | * | 2/1940 | 418/225 |
| WO | WO92/14037 | | 8/1992 | |

* cited by examiner

*Primary Examiner*—John J. Vrablik
(74) *Attorney, Agent, or Firm*—Jones, Walker, Waechter, Poitevent, Carrere & Denegre, LLP

(57) ABSTRACT

A roller vane motor having a housing and a stator positioned on an inside surface of the housing. The stator has an internal wall with an inlet port and an outlet port and the portion of this internal wall at the outlet port tapers open at an angle of less than 45 degrees relative to a tangent of the internal wall. A rotor assembly is positioned within the stator. The rotor assembly includes: i) a rotor shaft, ii) a plurality of flutes extending from the rotor shaft; and iii) cylindrical rollers positioned between said flutes.

22 Claims, 15 Drawing Sheets

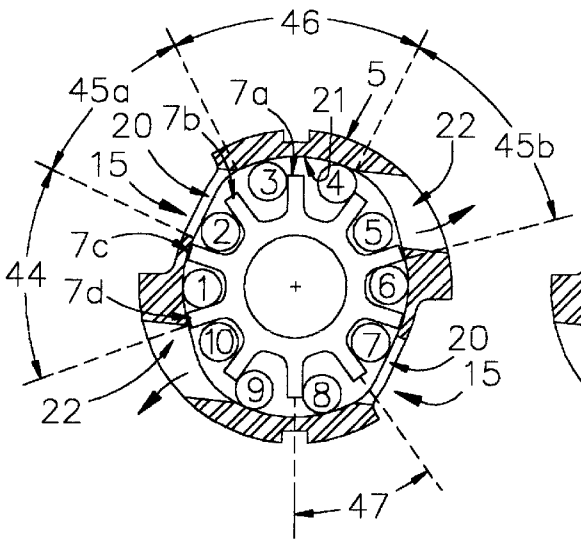
Figure 8A
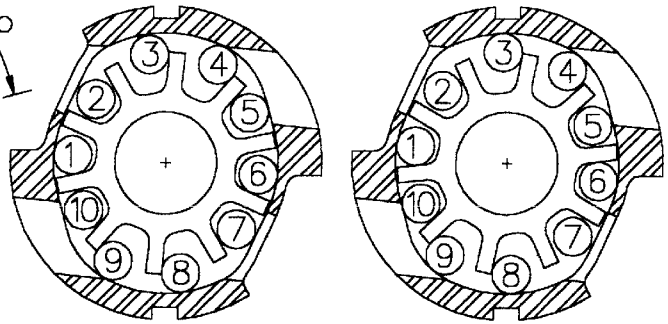
Figure 8B
Figure 8C
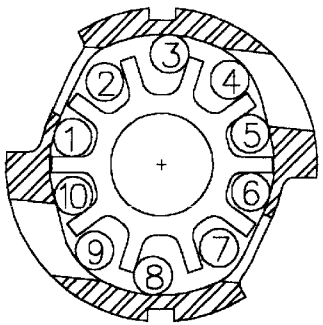
Figure 8D
Figure 8E
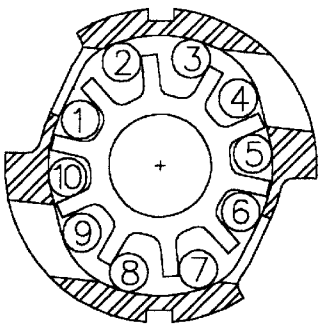
Figure 8F
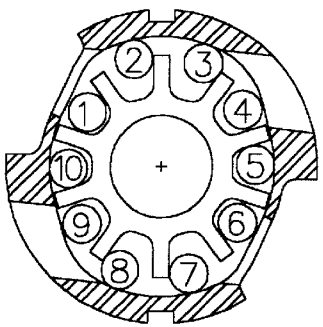
Figure 8G

DOWNHOLE ROLLER VANE MOTOR

BACKGROUND OF THE INVENTION

The present invention relates to downhole fluid driven motors used in the oil and gas drilling industry. In particular, the present invention relates to an improved roller vane motor.

There are various types of fluid driven motors which are designed to be incorporated into a drill string and are used to power (supply torque to) drill bits and other downhole tools. One type is the roller vane motor. The roller vane motor will normally be positioned in the drill string above the tool to be driven. A fluid (e.g. water, drilling mud, etc.) is pumped through the roller vane motor causing the motor to generate torque. FIG. 1 shows a cross-sectional view of a typical prior art roller vane motor 60. The motor 60 will generally comprise a stator 61 and a rotor 63. Rotor 63 will further include a series of flutes 66 with pockets 67 formed between flutes 66 and rollers 65 positioned in pockets 67. A fluid supply valve 68 will be formed through the center of rotor 63. Fluid passages 69 will communicate between supply valve 68 and pockets 67. Stator 61 will include interior stator walls which have varying radii. Portions of the stator wall will have a short radius (short radius portion 64*a*) approximate to the radius of flutes 66, such that flutes 66 forms a seal as they pass the short radius. Other portions of the stator wall will have a long radius (long radius portion 64*b*) which allows roller 65 to travel partially out of pockets 67. The stator will also have fluid exhaust ports 62 proximate said short radius stator wall portions. These fluid exhaust ports 62 are typically oriented radially outward from rotor 63 as suggested in FIG. 1.

In operation, fluid will be pumped down the drill string and will enter fluid supply valve 68. Rollers 65 which are facing a long radius portion 64*b* of the stator wall will tend to be pushed outward by the flow of fluid. Viewing in particular the roller designated 65*a*, it can be seen how rollers 65 will form a seal between rotor 63 and the long radius portion 64*b* of the stator wall and prevent the flow of fluid in the gap between rotor 63 and the stator wall. Another seal is formed between the flutes 66 of rotor 63 and the short radius portion 64*a* of the stator. Following the flow arrows in FIG. 1, it can be seen how fluid to the right of roller 65*a* may escape through exhaust port 62 and thus will be at the lower pressures existing outside the stator. On the other hand, higher pressure fluid flowing out of supply valve 68 into pockets 67 will be contained between the seal formed by flute 66 and short radius portion 64*a* and the seal formed by roller 65*a* engaging both the long radius portion 64*b* and the flute 66. The net effect of this arrangement is the accumulation of high pressure on the left side of roller 65*a* and lower pressure on the right side. Therefore, roller 65*a* will tend to move right toward exhaust port 62 and impart torque to rotor 63. Roller 65*a* will continue to impart torque to rotor 63 until roller 65*a* comes into contact with short radius portion 64*a* of the stator and roller 65*a* is forced into pocket 67, allowing the high pressure fluid behind roller 65*a* to escape through exhaust port 62.

One disadvantage with this prior art roller vane motor is that it is highly vulnerable to particulate matter in the power fluid. Very close tolerances are required where seals are intended to be formed, e.g. between flutes 66 and short radius portion 64*a* or between fluid passages 69 and the fins on supply valve 68. Particulates in the driving fluid either tend to stall the motor and/or seriously abrade the sealing surfaces. Additionally, the fins on supply valve 68 provide a very inefficient mechanism for sealing fluid passages 69. When these fins attempt to seal fluid passages 69, they present a critical short leak path between high and low pressure regions. Another disadvantage is the abrupt or violent manner in which rollers 65 will be forced into pockets 67 as the rollers approach short radius portion 64*a* of the stator. This abrupt action causes severe wear on both the roller and stator wall, thereby significantly reducing the useful life of the motor. It is believed that the degree of force with which rollers 65 are shifted in and out of pockets 67 is increased by exhaust ports 62 being oriented at a high angle in relation to the tangent of the stator wall at the exhaust port. For example, FIG. 1 illustrates a dashed line 71 tangent to the stator wall approaching exhaust port 62. Dashed line 72 shows the orientation of the exhaust port 62. The angle $\alpha$ demonstrates the orientation of exhaust port 62 to tangent line 71 is approximately 90°. Additionally, when the roller vane motor is starting up from a stationary position, there is a tendency for the motor to "lock up" because the rollers are forced into exhaust ports 62 and tend to remain there. This tendency to lock-up is also believed to be caused or aggravated by exhaust ports being oriented at high angles relative to the tangent of the stator wall.

SUMMARY OF THE INVENTION

The present invention provides a roller vane motor for use in downhole drilling operations or various other applications. The roller vane motor has a housing and a stator positioned on an inside surface of the housing. The stator has an internal wall with an inlet port and an outlet port formed therein and the portion of this internal wall at the outlet port tapers open at an angle of less than 45 degrees relative to a tangent of the internal wall. A rotor assembly is positioned within the stator and includes: i) a rotor shaft, ii) a plurality of flutes extending from the rotor shaft; and iii) cylindrical rollers positioned between said flutes.

BRIEF DESCRIPTION OF THE DRAWINGS

FIGS. 8A–8G are similar to FIG. 3B, but illustrate the rollers in various positions during operation.

DETAILED DESCRIPTION OF THE INVENTION

Figure 1:
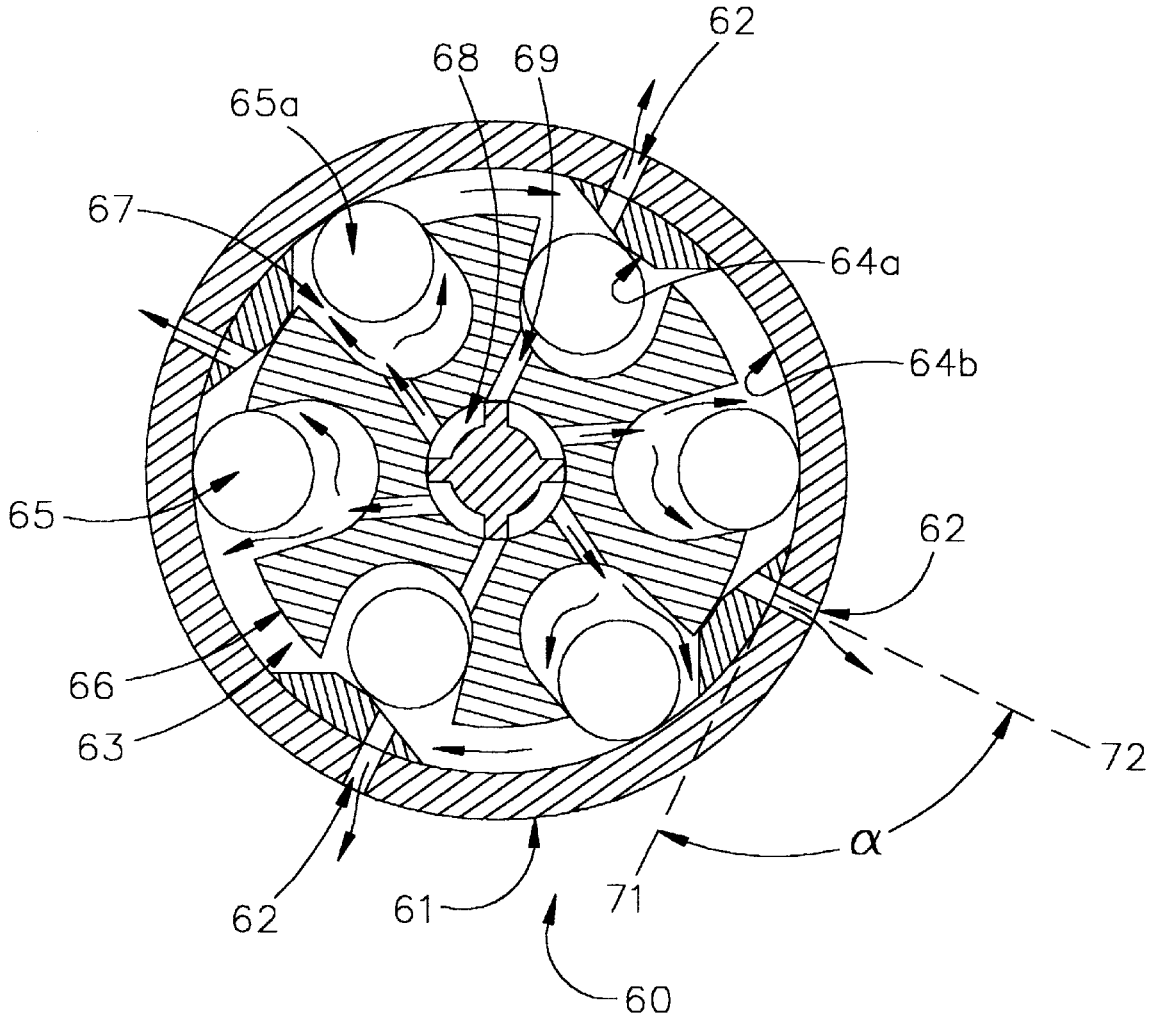
Figure 1 Prior Art
FIG. 1 is a cross-sectional view of a prior art roller vane motor.
Figure 2:
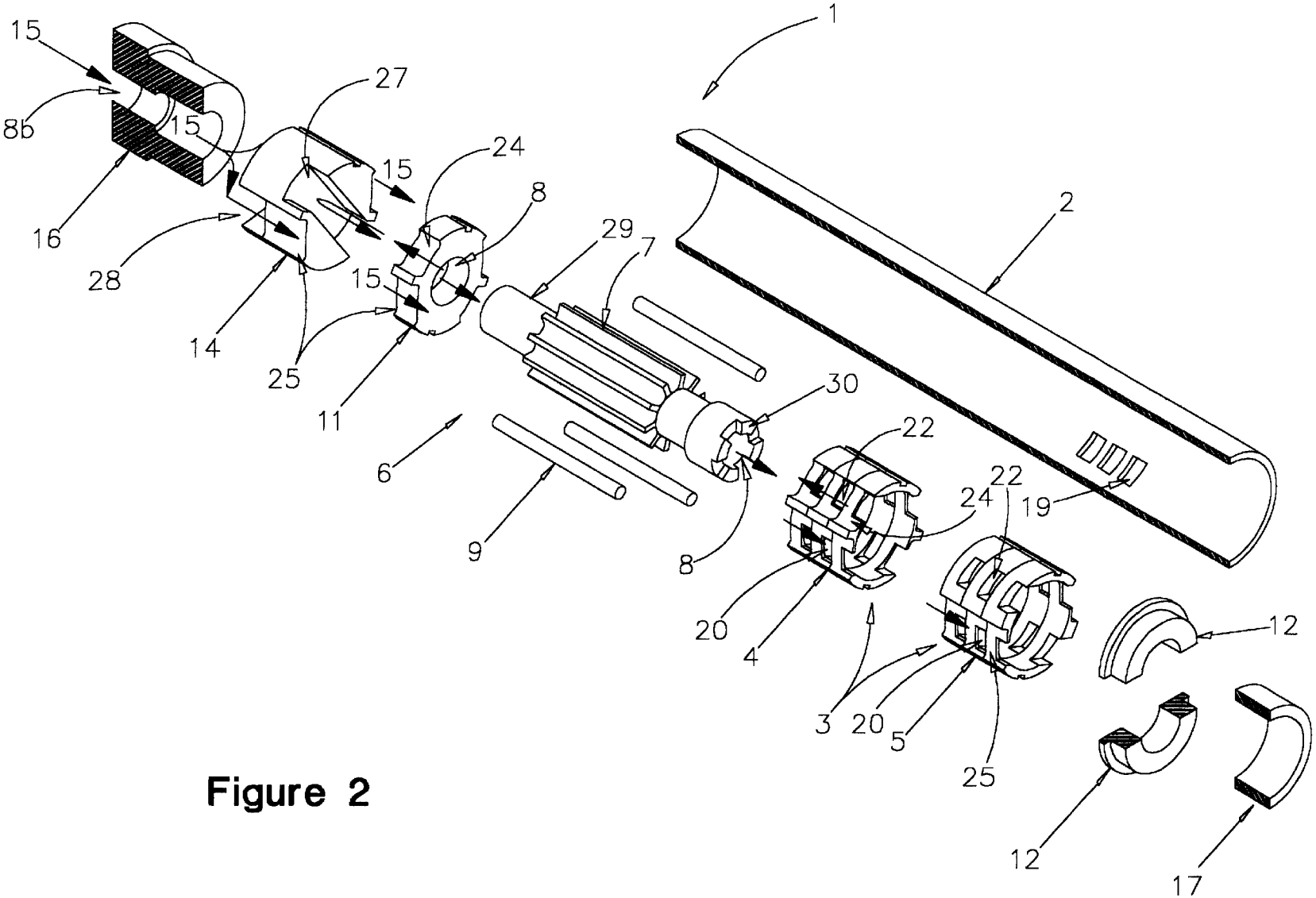
FIG. 2 is an exploded perspective view of the main elements of the roller vane motor.
Figure 3B:
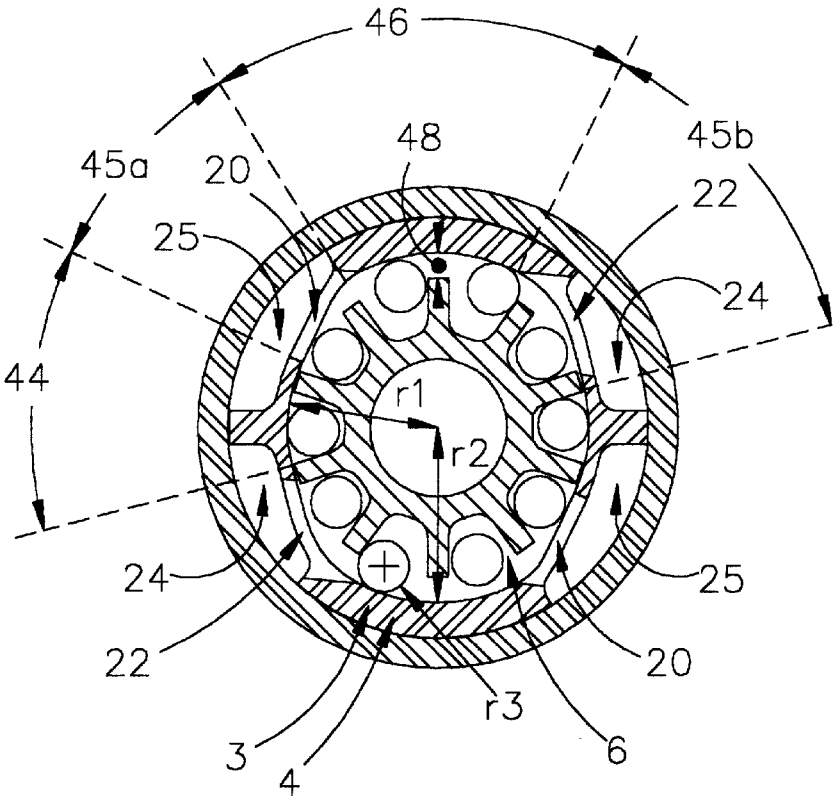
FIG. 3B is a cross-sectional view of the roller vane motor of the present invention showing the first stage stator.
Figure 3A:
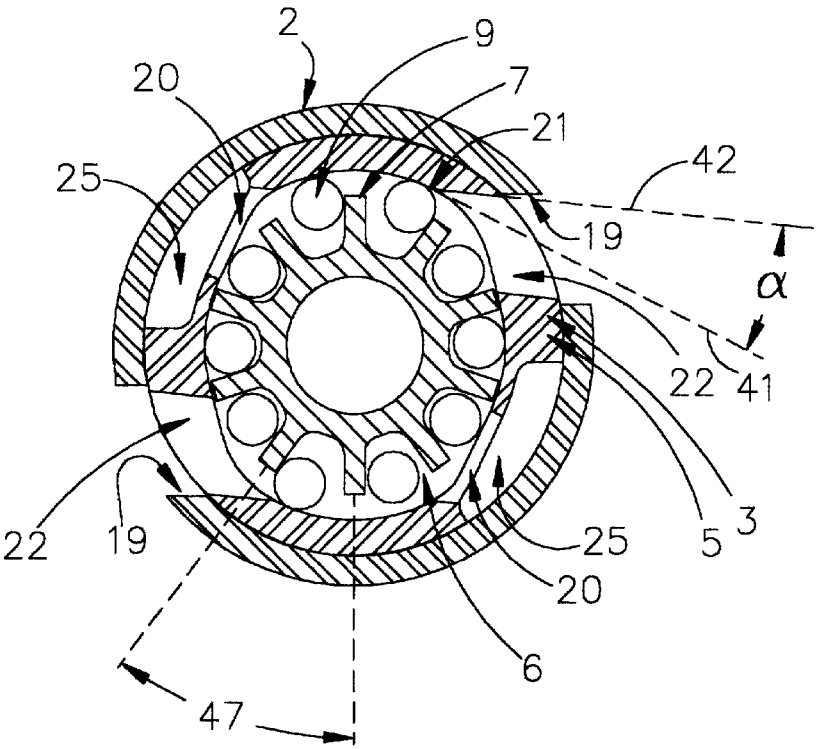
FIG. 3A is a cross-sectional view of the roller vane motor of the present invention showing the second stage stator.

FIG. 2 shows an exploded perspective view of roller vane motor 1 of the present invention. The various elements of motor 1 seen in FIG. 2 are best visualized by also referencing the cross-sectional views seen in FIGS. 3A and 3B. Motor 1 includes a cylindrical housing 2 (only half of which is seen in FIG. 2) which has housing exhaust ports 19 formed therein. Positioned within housing 2 is a cylindrical stator 3 which may be further defined as first stage stator 4 and second stage stator 5. Descriptions of "stator 3" herein will refer to characteristics common to both first stage stator 4 and second stage stator 5. Additionally, first and second stage stators 4 and 5 may be referred to as stator cylinders. Positioned within stator 3 will be rotor assembly 6. Rotor assembly 6 will generally comprise a rotor shaft 29. In the embodiment of FIG. 2, rotor shaft 29 has a center aperture 8 formed there through. However, other embodiments shown below need not include a center aperture. One end of rotor shaft 29 will have rotor gear face 30 formed thereon. A series of flutes 7 extend radially outward from rotor shaft 29 and a series of rollers 9 are positioned between flutes 7. While FIGS. 3A and 3B show ten flutes 7 with ten rollers 9, motor 1 could have fewer or more flutes and rollers. However, it is generally desirable to provide motor 1 with an even number of rollers 9 to insure force balanced operation. The material from which rollers 9 are constructed will vary depending upon the application in which motor 1 is employed. Brass rollers 9 have been found to provide good wear properties. However, in high temperature applications, it may be more desirable to employ steel rollers 9. In ordinary temperature, but highly corrosive applications, it may be preferable to use hard polymer rollers. Stator 3 may also be formed of a variety of materials, although it is generally preferred that stator 3 be of a material harder than rollers 9. As seen in FIG. 2, the surface of rotor shaft 29 along which flutes 7 run is solid and there are no communication passages from the surface containing flute 7 to center aperture 8 such as found in many prior art devices (e.g. fluid passages 69 in FIG. 1).

Figure 5B:
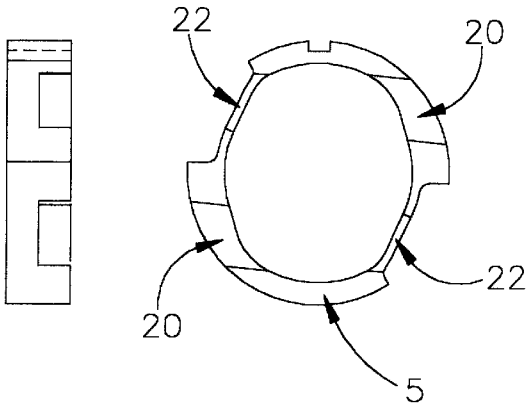
FIGS. 5A–5D are planar and side views of various components of the roller vane motor.
Figure 5D:
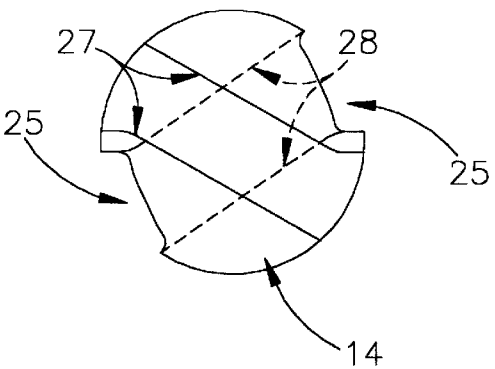
Figure 5A:
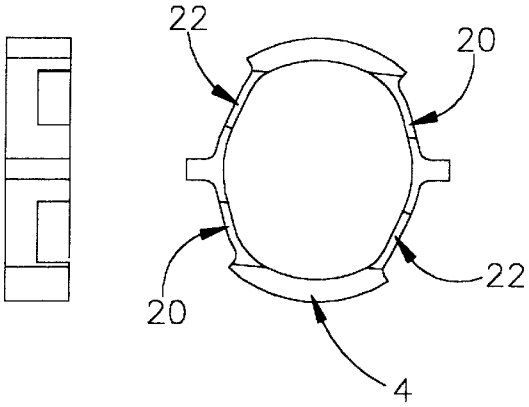
Figure 5C:
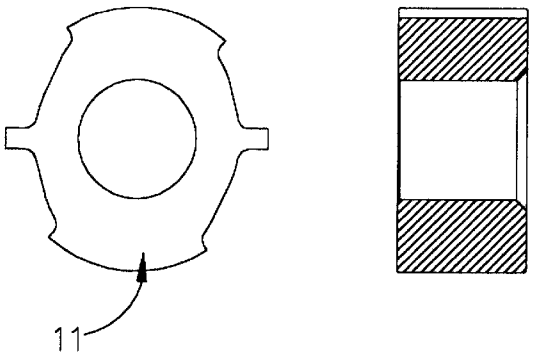

Viewing FIG. 2, rotor shaft 29 will engage upper rotor bearing 11, which will in turn be positioned against flow control block 14. Flow control block 14 then abuts against upper casing 16. Viewing FIGS. 2 and 5D, it can be seen how control block 14 includes a splitter channel 28 formed on the face abutting upper casing 16 and cross-flow channel 27 on the face abutting rotor bearing 11. The functions of splitter channel 28 and cross-flow channel 27 will be explained in greater detail below. It will be understood that upper casing 16 is the top end of the tool which will eventually connect to the drill string. Fluid will flow through center aperture 8*b* in upper casing 16 until the fluid encounters control block 14, after which the fluid will be directed to power motor 1 as described below.

FIGS. 3A and 3B best illustrate how rotor assembly 6 is positioned within first stage stator 4 (FIG. 3B) and second stage stator 5 (FIG. 3A). As shown in FIG. 3B, stator 3 will have a minimum radius $r_1$, and a maximum radius $r_2$. While not explicitly shown, it will be understood that stator 3 in FIG. 3A has the same minimum radius $r_1$ and a maximum radius $r_2$. The flutes 7 will have a length or radial dimension such that flutes 7 may just pass minimum radius $r_1$ without impinging on the stator wall. This radial dimension of flutes 7 will then create a clearance distance 48 between the end of flutes 7 and the stator wall at maximum radius $r_2$. Each of the rollers will have a radius $r_3$. In a preferred embodiment, the roller radius $r_3$ will be equal to at least the clearance distance 48.

Both first stage stator 4 and second stage stator 5 will have inlet headers 25. The purpose of inlet headers 25 is to form a path for the fluid driving roller vane motor 1 to flow from the upper casing 16 into stator 3 in order to drive rotor 6. FIG. 2 best illustrates this flow of pressurized fluid (see flow arrows 15) along inlet header 25. It can be seen that channels for inlet header 25 are formed in both flow control block 14 and upper rotor bearing 11, as well as in stator stages 4 and 5. Pressurized fluid 15 flows through the center of upper casing 16 until the fluid encounters flow control block 14. Splitter channel 28 causes the flow from upper casing 16 to be divided between the two inlet headers 25 formed on each side of flow control block 14 (see FIG. 5D). Inlet headers 25 terminate at lower rotor bearing 12, which has a collar blocking further flow of fluid along the outside of stator 3. Referring back to FIGS. 3A and 3B, pressurized fluid will flow down inlet header 25 and enter the inlet ports 20. The fluid will drive the rollers 9 and rotor assembly 6 toward the lower pressure area at outlet port 22, thereby imparting torque to rotor assembly 6. Upon reaching outlet port 22, the fluid will take a different path depending on whether the fluid is exiting first stage stator 4 or second stage stator 5. As seen in FIG. 3B, fluid exiting outlet port 22 in first stage stator 4 will enter outlet header 24. FIG. 2 best illustrates how fluid will follow a path along outlet header 24 back toward flow control bock 14. Upon reaching flow control block 14, the fluid will encounter cross flow channel 27 which will allow the fluid to flow to the lower pressure area within center aperture 8, then through rotor shaft 29 and eventually to whatever tool is attached to motor 1. Referring to FIG. 3A, it can be seen that fluid exiting outlet port 22 of second stage stator 5 will take a different path and flow out of exhaust port 19 formed in housing 2 to the lower pressure areas outside the tool, but within the well bore.

It has been found that certain configurations of outlet port 22 and exhaust port 19 lead to substantially improved operation of motor 1. FIG. 3A illustrates how exhaust port 19 does not open to the exterior of the stator at a high angle (i.e. in a virtually radial direction) as does the prior art exhaust port 62 seen in FIG. 1. Rather, it can been seen in FIG. 3A how the internal stator wall 21 tapers toward (or transitions into) exhaust port 22 at a relatively low angle. Dashed line 41 illustrates the tangent of stator wall 21 at the beginning of outlet port 22. Dashed line 42 represents the angle at which the portion of stator wall 21 at outlet port 22 begins to taper way from tangent line 41 as stator wall 21 transitions into outlet port 22. This angle is represented by $\alpha$ in FIG. 3A. In one preferred embodiment, $\alpha$ will be less than 45° or in a more preferred embodiment, approximately 21°. In the embodiment shown, a similar angle is formed on exhaust port 19 and outlet port 22 of first stage stator 4 as seen in FIG. 3B. However, it is not as critical that any particular angle be formed at exhaust port 19 and other angles on exhaust port 19 are intended to come within the scope of the present invention. Manufacturing stator outlet ports with an angle $\alpha$ of less than 45° is one configuration which allows motor 1 to generally operate more efficiently. This low angle typically results in less wear on the rollers and the stator. Additionally, the likelihood of motor 1 "locking up" during starting, because of the rollers lodging against the outlet ports, is much reduced.

FIGS. 8A to 8G illustrate the sequence of operation of the rollers in second stage stator 5. High pressure fluid (represented by fluid flow arrow 15) will enter inlet port 20 and will tend to push roller #3 against the top internal wall 21 of the stator, thereby forming a seal between flute 7*a* and wall 21. This is referred to as a "working seal" since roller #3 (and #4) tend to move rotor assembly 6 clockwise and produce useful work. Fluid will also flow past flute 7*c* toward roller #1. However, roller #1 will form a seal between the stator wall and flute 7*d*, which prevents fluid from exiting from the outlet port 22 immediately below flute 7*d*. The seal between roller #1 and the stator wall is referred to as a "back seal." It will be apparent that rollers #3 and #4 produce a greater torque in the clockwise direction than roller #1 does in the counterclockwise direction since rollers #3 and #4 are against stator wall 21 at the maximum radius $r_2$ while roller #1 is against stator wall 21 at the minimum radius $r_1$. Thus rollers #3 and #4 impart a larger moment to rotor assembly 6 than roller #1. As rotor assembly 6 continues to rotate, roller #4 will approach outlet port 22 (FIG. 8B) and eventually the seal between stator wall 21 and roller #4 will be broken as roller #4 moves past outlet port 22 (FIG. 8C). Shortly afterwards, roller #2 will form a working seal with the stator wall (FIG. 8E) and roller #1 will break its back seal while roller #10 now forms the back seal (FIG. 8F).

Figure 10:
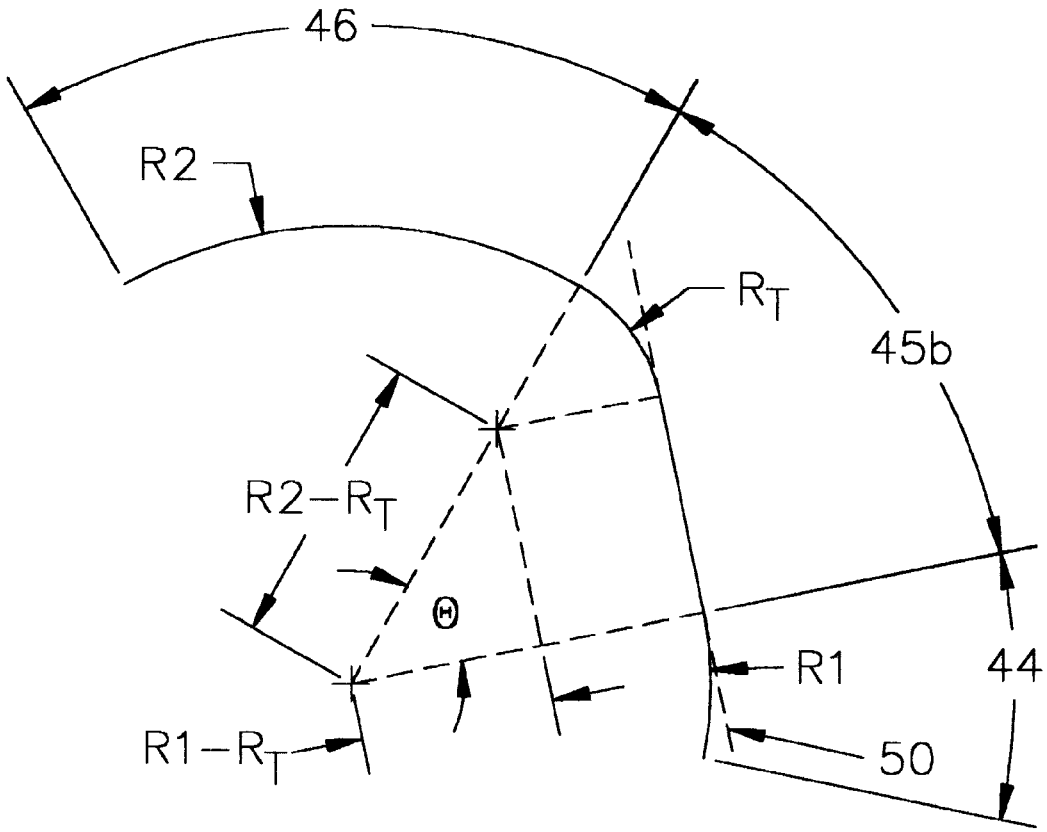
FIG. 10 is a graphical illustration of the outlet transition contour.

FIGS. 8A and 3B show the separate sections of stator wall 21 which may be denominated as a working seal arc 46, a back seal arc 44, an inlet transition contour 45*a*, or an outlet transition contour 45*b*. FIG. 3A also illustrates a flute tip circular pitch 47, which is the angular distance between two adjacent flutes 7. The back seal arc 44 should be at least as long as flute tip circular pitch 47. In one embodiment, working seal arc 46 is at least equal to the length of flute tip circular pitch 47, and in more preferred embodiments, working seal arc 46 is between approximately 1.3 to approximately 1.5 times the length of flute tip circular pitch 47. The length of transition contours 45*a* and 45*b* are generally sized to meet the requirements of working seal arc 46 and back seal arc 44. The embodiment of outlet transition contour 45*b* seen in the figures is illustrated graphically in FIG. 10. FIG. 10 shows the maximum radius ($R_2$) of the stator wall and the minimum radius ($R_1$) of the stator wall. An angle ($\theta$) is defined as the angle between the end of the working seal arc 46 and the beginning of the back seal arc 44. A transition radius ($R_T$) is determined by the relationship:

$$R_T = \frac{R_1 - R_2\cos\theta}{1 - \cos\theta}$$

The transition radius $R_T$ defines a transition arc which runs from the end of working seal arc 46 to line 50 which is tangent to the end of back seal arc 44. Once the transition arc intersects line 50, contour 45*b* extends in a straight line to the end of back seal arc 44. However, many alternative contour designs will be apparent to those skilled in the art and could be utilized in the present invention. Additionally, while the figures show the stators having two working seal arcs, other embodiments may have 3 or more working seal arcs. As a general rule, it is desirable to have a ratio of the number of working seal arcs to the number of rollers such that the number of rollers divided by the number of working seal arcs will be a whole number.

Figure 4:
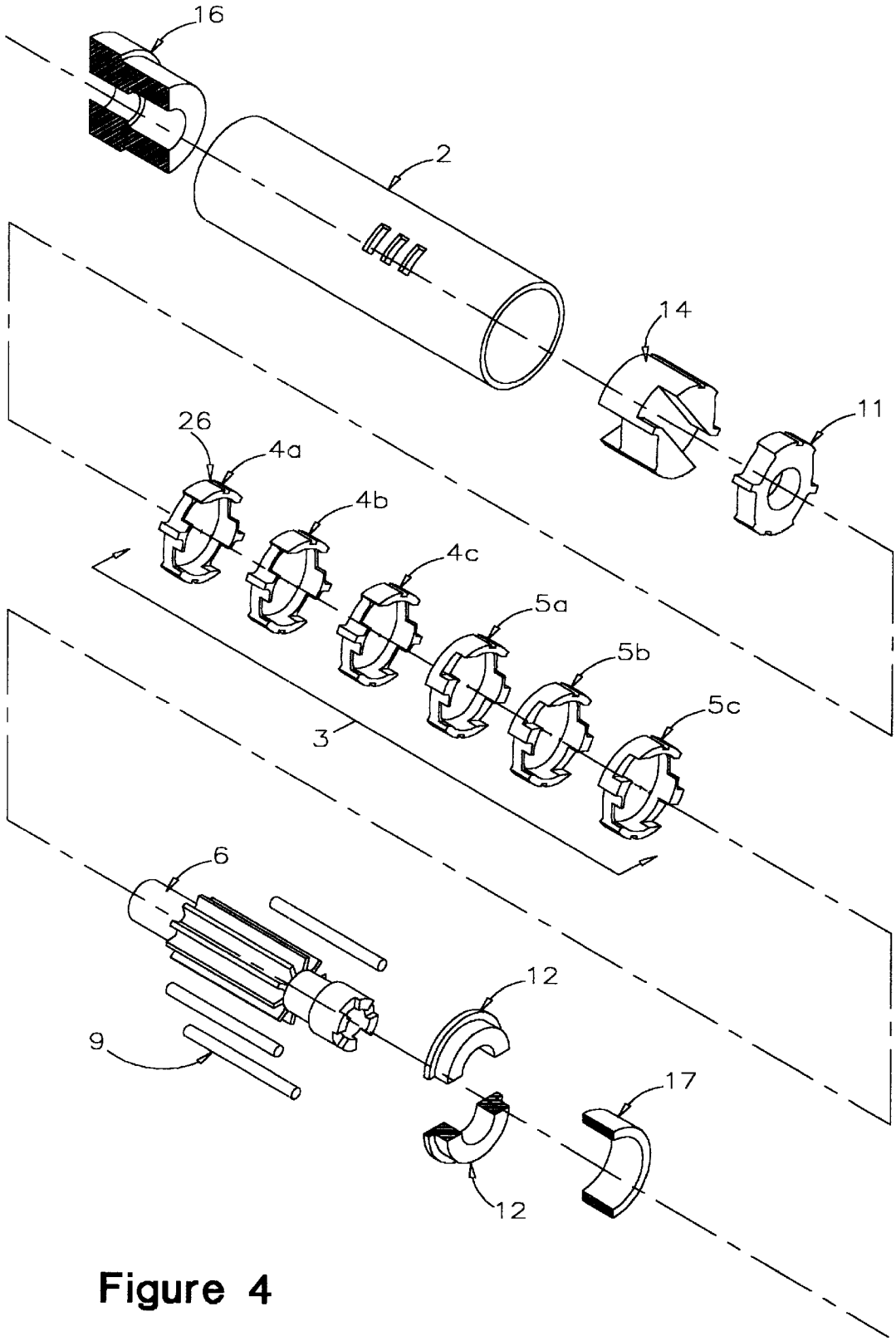
FIG. 4 is an exploded perspective view of the roller vane motor which further illustrates the stators in individual stator sections.
Figure 7:
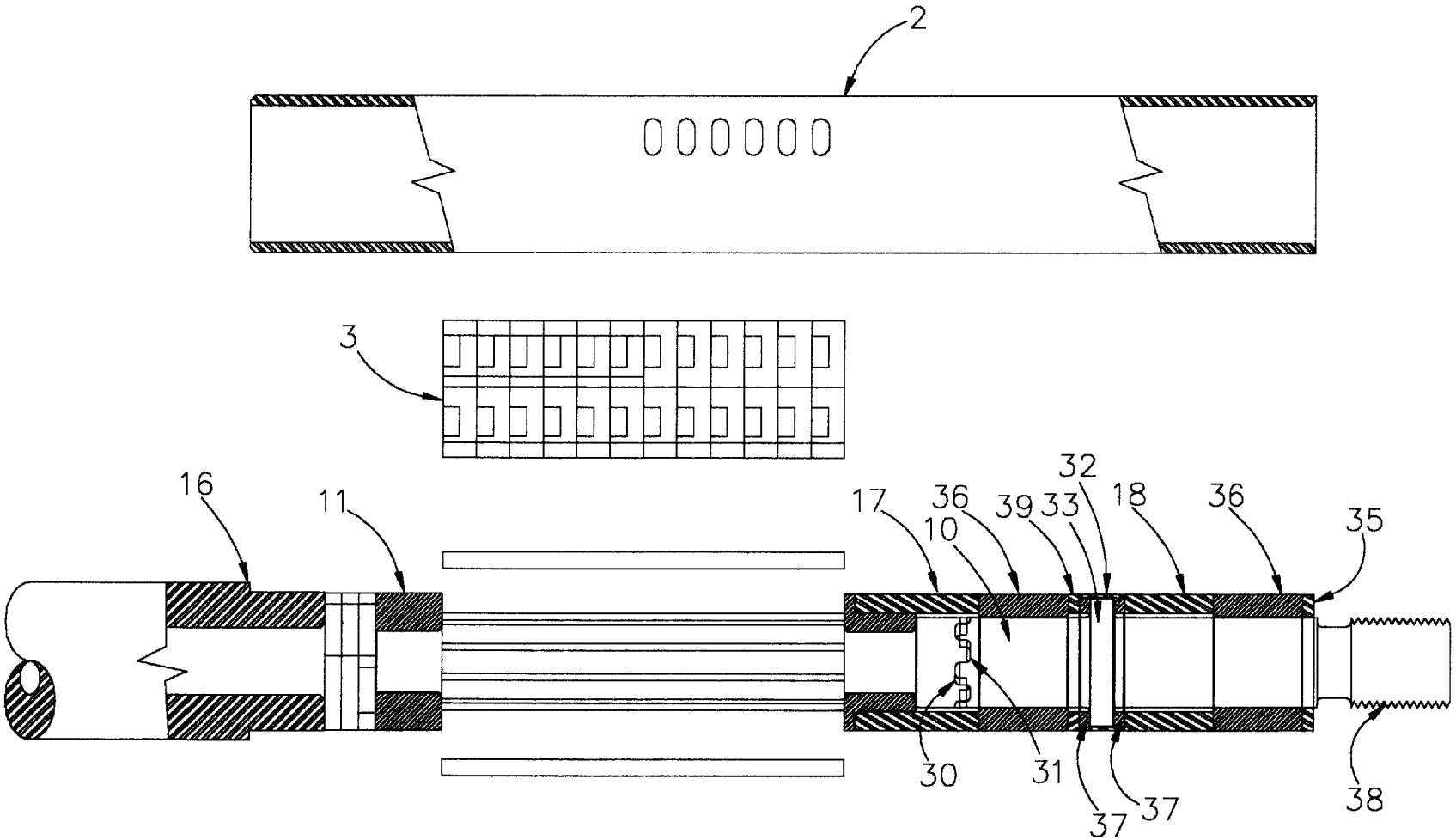
FIG. 7 is a side assembled view of the motor seen in FIG. 6.

FIG. 4 illustrates another aspect of the present invention. FIG. 4 shows how first stage stator 4 will be formed from a series of stator segments 4*a*, 4*b*, and 4*c*. Likewise, second stage stator 5 will be formed from a series of stator segments 5*a*, 5*b*, and 5*c*. Forming the stator 3 from separate sections greatly reduces the complexity of the machining required to produce stator 3. In many instances, it would be cost prohibitive to start with a single uniform tube of material and attempt to mill the necessary inside dimensions while also precisely mill out the inlet ports 20 and outlet ports 22 along the length of the tube. On the other hand, it is a much simplified process to take a small section of tubing, perhaps 1 to 2 inches in length, and mill from one end the necessary ports and internal dimensions to create stator sections such as seen in FIG. 4. To assemble the stator from various stator sections, it is only necessary to stack the stator sections end to end as seen in FIGS. 2 and 7, thereby greatly simplifying the manufacturing process. FIG. 4 also shows how it may be desirable to cut small guide channels 26 on the top of the stator segments. Guide channels will mate with a small guide rail (not shown) on the interior wall of housing 2. This will help insure easy alignment of successive stator segments on insertion into housing 2.

Viewing FIGS. 2, 3A and 3B, one of the advantages of a motor 1 having first and second stage stators is the ability to vary the percentage of fluid which travels down center aperture 8 (and eventually to the tool positioned in the drill string below motor 1) as opposed to exiting into the well bore via exhaust ports 19. Varying the amount of fluid traveling down center aperture 8 may be desirable based on the type of tool being used, the drilling conditions, or a variety of other circumstances. As described above, fluid leaving outlet port 22 of first stage stator 4 will eventually be directed to center aperture 8 and down hole to whatever tool is positioned below motor 1 in the drill string. If it is desired to direct a greater percentage of fluid down center aperture 8, it is only necessary to increase the number of first stage stator segments and reduce the number of second stage stator segments (and correspondingly reduce the number of exhaust ports 19). This results in a greater percentage of the fluid being directed into outlet headers 24 as opposed to the fluid exiting through exhaust ports 19. Alternatively, the amount of fluid flowing through center aperture 8 may be decreased by increasing the number of second stage stator segments (and exhaust ports 19) while reducing the number of first stage stator segments, thereby exhausting a greater percentage of the fluid into the well bore. When the stator stages are formed of individual stator sections, this control of the percentage of fluid flow through center aperture (which may be varied from 0% to 100% of the flow entering the tool) is much easier to vary as dictated by the particular drilling applications being carried out. Thus, the depiction in the Figures of an equal number of first and second stage stator segments is merely illustrative and the ratio of first and second stage stator segments may be varied as required.

Figure 6:
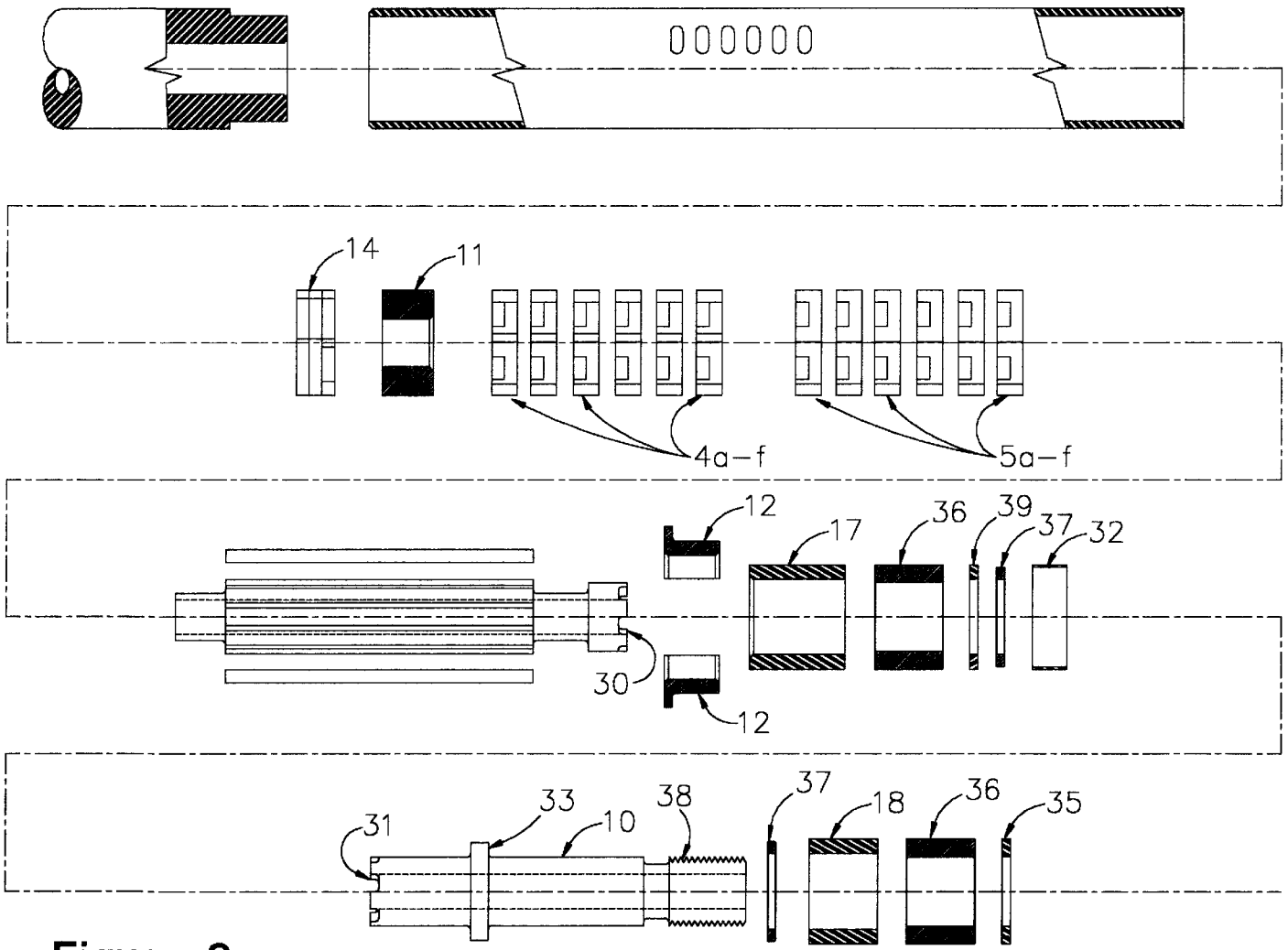
FIG. 6 is a side exploded view of the roller vane motor.
Figure 11:
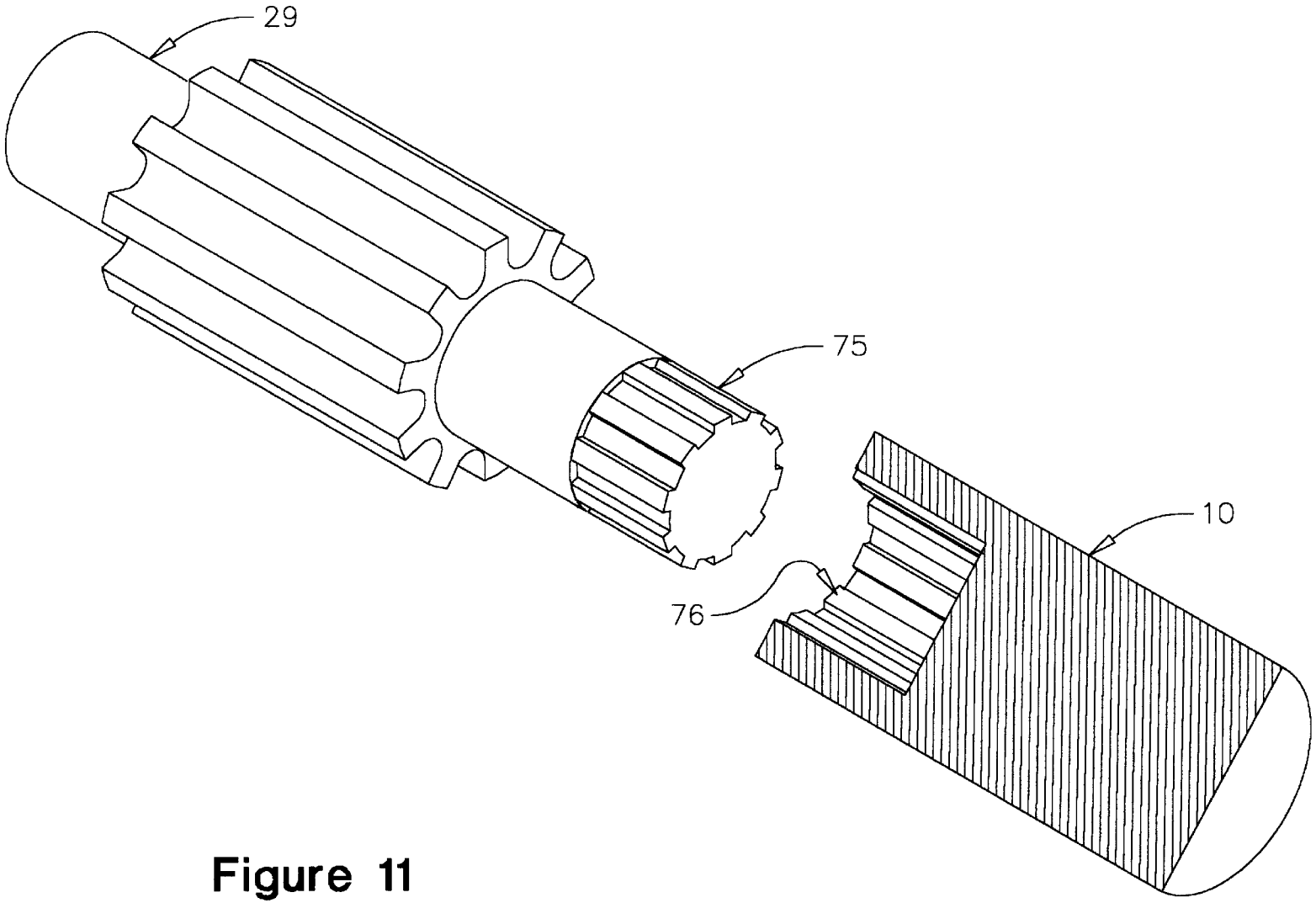
FIG. 11 is an alternate embodiment of connecting mechanism on the spindle.

FIG. 6 illustrates additional components of motor 1, most notably spindle 10. Spindle 10 includes spindle gear face 31, thrust collar 33, and threaded tool connector 38. As best seen in FIG. 7, spindle gear face 31 will engage rotor gear face 30 such that torque maybe transferred from rotor assembly 6 to spindle 10 and finally to whatever tool has been coupled to threaded tool connector 38. Naturally, the connecting mechanism between spindle 10 and rotor shaft 29 is not limited to gear faces 30 and 31 as seen in FIG. 6. For example, one alternative would be the splined connection mechanism seen in FIG. 11. Male splines 75 could be formed on rotor shaft 29 and female splines 76 formed within spindle 10. These and all other conventional connection mechanisms come within the scope of the present invention. Various components will be positioned on spindle 10. FIG. 6 shows these components as lower rotor bearing support 17, spindle bearing 36, upper spacer 39, spindle thrust bearing 37, thrust bearing spacer 32, spindle thrust bearing 37, lower spacer 18, a second spindle bearing 36 and lower case endplate 35. As is well known in the art, FIG. 7 illustrates how spindle thrust bearings 37 abut thrust collar 33 while floating within the inner diameter of housing 2. In effect, thrust bearings 37 are free to "float" while being constrained in the axial direction by lower spacer 18 and upper spacer 39 which are separated by spacer 32, thereby limiting axial movement of spindle 10 toward the lower end of the tool. At the same time, spindle bearings 36 allow spindle 10 to rotate freely when torque is transferred from rotor gear face 30 to spindle gear face 31. Typically, lower end case plate 35 will be secured to housing 2 by brazing, welding, threaded connections, or any other conventional means in order to secure spindle bearing 36 and the previous components within housing 2.

Figure 9A:
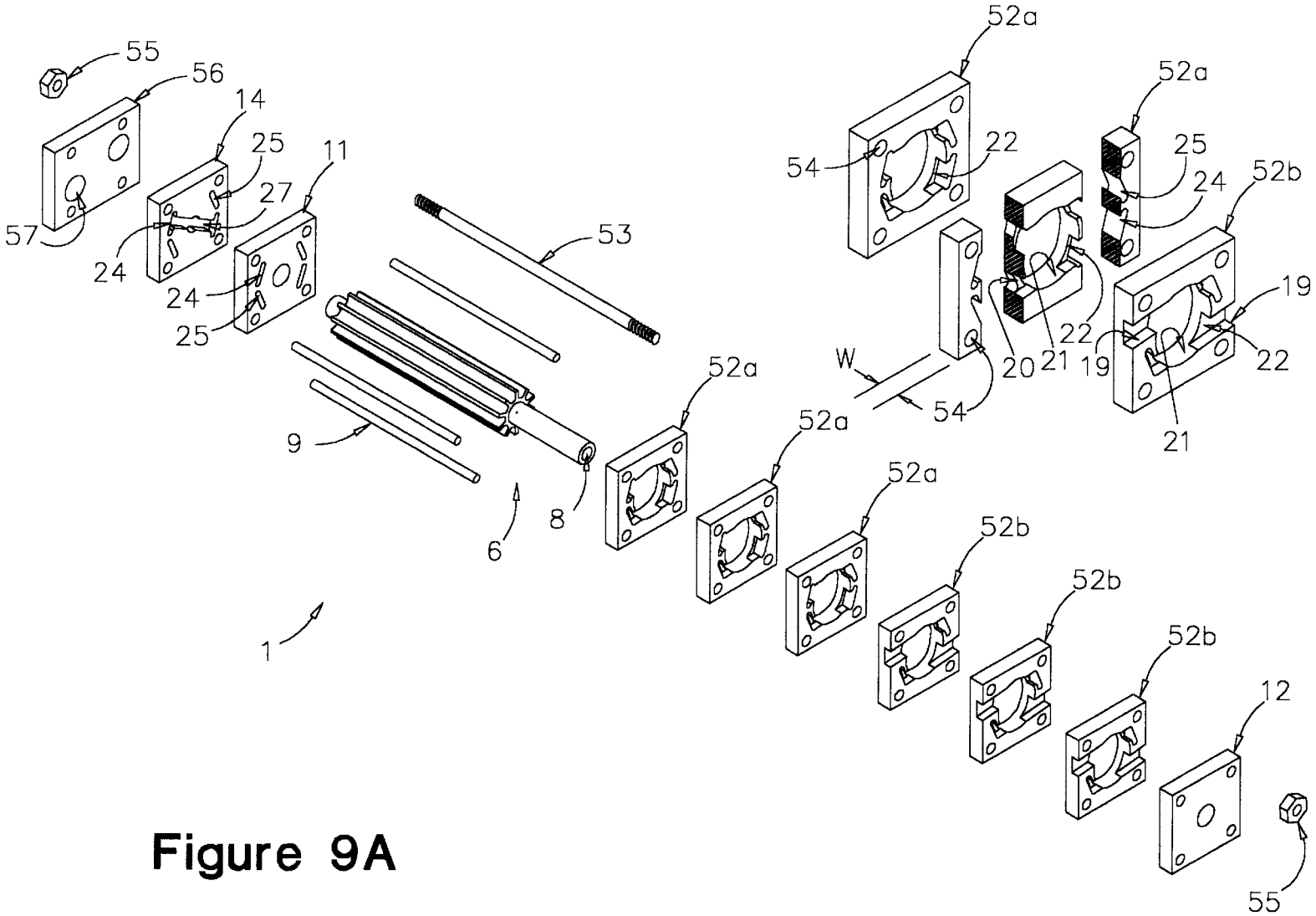
FIGS. 9A–9C are alternate embodiments of the present invention which illustrate the housing being formed by individual sections.
Figure 9B:
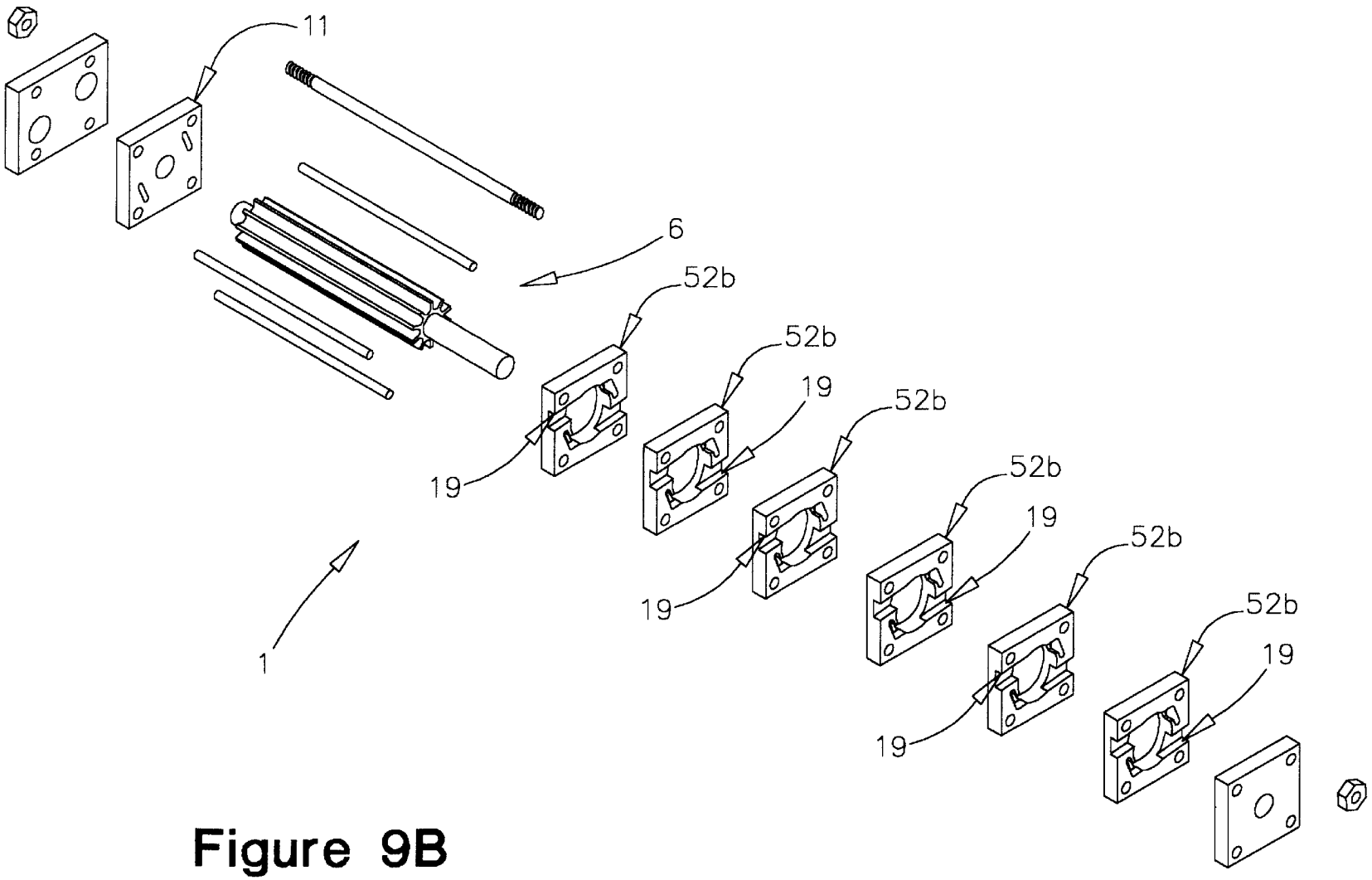
Figure 9C:
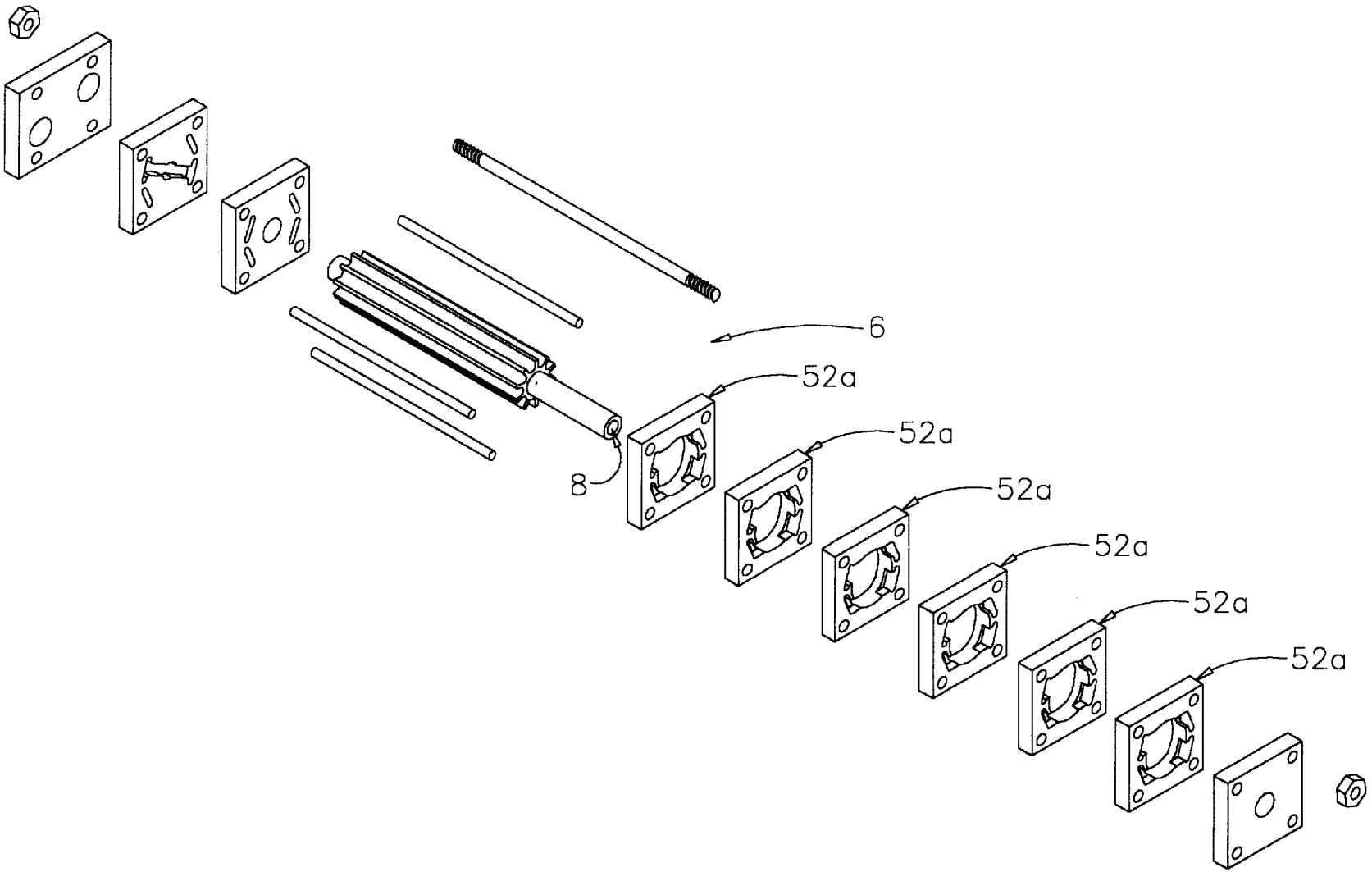

Another embodiment of the present invention is illustrated in FIGS. 9A–9C. In this embodiment, the motor housing is formed of housing sections 52. FIG. 9A shows two distinct housing sections 52*a* and 52*b*. Housing sections 52 may be manufactured from solid sections of material which have the appropriate stator walls, ports, and headers milled therein. As best seen in the enlarged partitioned view of housing section 52*a* in FIG. 9A, the housing sections will have an stator internal wall 21 formed integrally with the housing section 52*a* (and also 52*b* ). Formed in internal wall 21 will be inlet ports 20 and outlet ports 22, which will communicate with inlet header passage 25 and outlet header passage 24, respectively, which are formed completely through the width "w" of housing section 52*a*. It will be understood that aligning multiple housing sections 52*a* or 52*b* will create continuous inlet and outlet headers. FIG. 9A also illustrates how housing sections 52*b* will have exhaust ports 19 which extend from outlet ports 22 to the exterior of housing sections 52*b*.

Motor 1 of FIG. 9A will be assembled by securing together the housing sections 52*a* and 52*b* along with the other elements including end block 56, flow control block 14, upper rotor bearing 11, and lower rotor bearing 12. Rotor assembly 6 and rollers 9 will be positioned within the housing sections 52*a* and 52*b* as with the previous embodiments of motor 1. A securing means such as bolts 53 (only one being shown in FIG. 9A) will hold the various sections of motor 1 together by passing through bolt apertures 54 and having nuts 55 engage the threaded ends of bolts 53. End block 56 has two apertures 57 to allow entry of whatever pressurized fluid will be driving motor 1. The pressurized fluid will flow through inlet headers 25 formed on flow control block 14 and upper rotor bearing 11. The pressurized fluid will impart torque to rollers 9 as described in reference the motor seen in FIG. 2. As also previously described, fluid returning by way of exhaust headers 24 will reach flow control block 14 and then be directed by cross flow channel 27 to center aperture 8 which passes through rotor assembly 6 to whatever tool or other devices is connected downstream of motor 1. Naturally, many variations of this configuration could come within the scope of the present invention. For example, the housing sections could be connected by any convention means and not simply bolts 53 passing through apertures 54. Likewise, flow control block 14 and end block 56 could be formed into a single unit. All such variations are included within the scope of the invention.

FIG. 9B illustrates a modification of the motor 1 seen in FIG. 9A. In FIG. 9B, all the housing sections are of the type 52*b* having exhaust ports 19. This eliminates the need for outlet header 24 and crossover block 14. It is also seen that rotor assembly 6 has a solid shaft rather that one formed with center aperture 8 as in FIG. 9A. FIG. 9C is largely the opposite in that all housing sections are of the type 52*a* which have no exhaust ports 19. All fluid flowing through motor 1 will be directed down center aperture 8 of rotor assembly 6 in FIG. 9C. Alternatively, while not shown in the drawings, the returning fluid could be directed straight back to the fluid pressurizing source if there were no tools below motor 1 which needed fluid for their operation. It is thus apparent from FIGS. 9A–9C that a stator could be formed of all sections 52*a*, all sections 52*b*, or any combination thereof.

Figure 12:
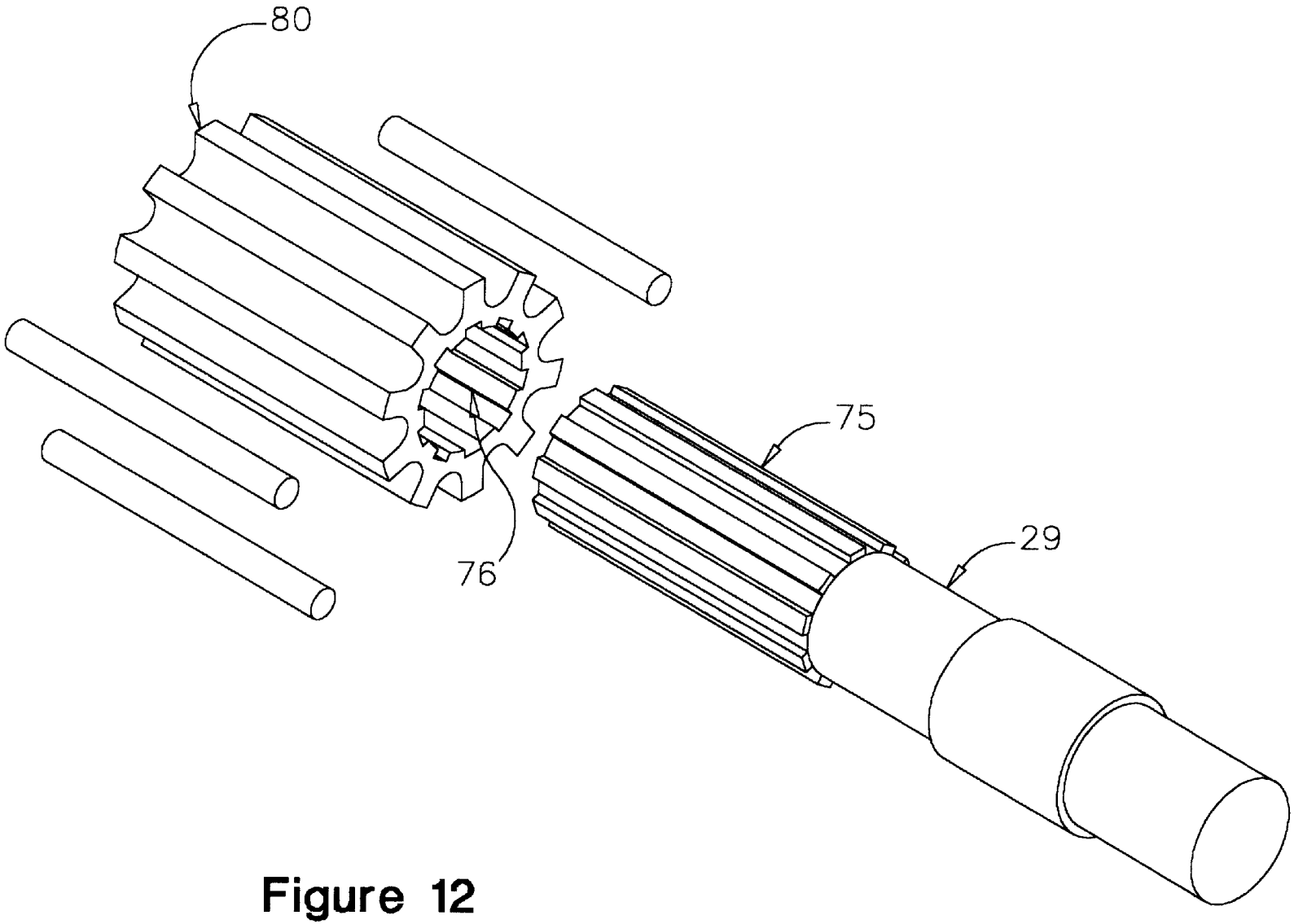
FIG. 12 is an alternate embodiment of how flutes are formed on the rotor shaft.
Figure 13:
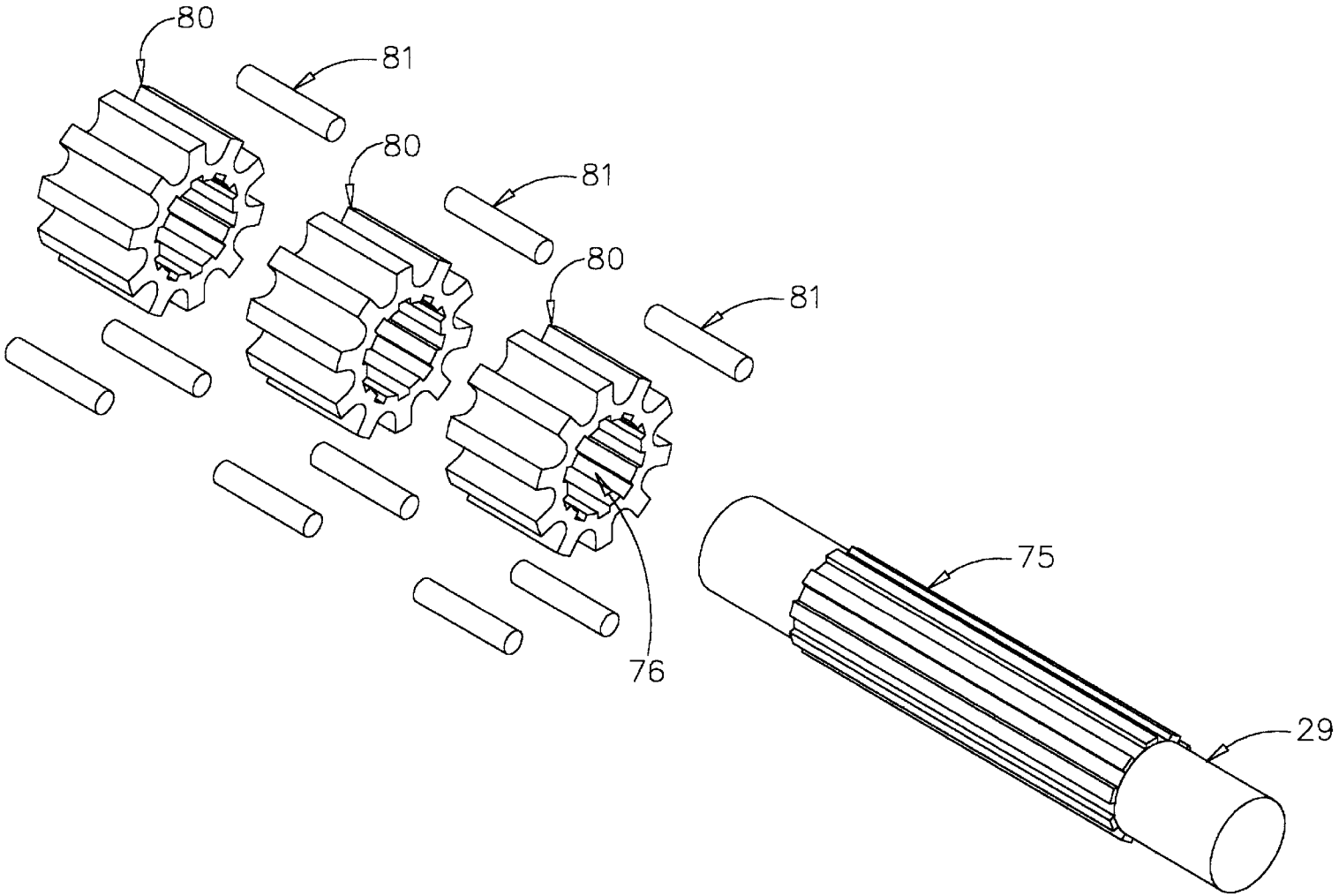
FIG. 13 illustrates an alternate embodiment with flute segments and roller segments.

While the present invention has been described in terms of specific embodiments, those skilled in the art will recognize many readily apparent variations. For example, while the stators are shown in FIG. 2 as being formed in sections, the stators could also be formed as a single cylindrical section or even be milled into the housing. Alternatively, the stators could be integrally formed within separate housing sections as shown in FIGS. 9A–9C. All of these variations should be considered different methods of positioning a stator within a housing. Moreover, FIGS. 12 and 13 illustrates how the flutes and rollers could also be formed in segments for ease of construction or to meet other special needs. FIG. 12 shows a single flute segment 80 which will be formed independently of rotor shaft 29. Rotor shaft 29 will have a series of splines 75 for engaging splines 76 on the flute segment 80. FIG. 13 shows a rotor having multiple flute segments 80 which will also have splines for engaging rotor shaft 29. FIG. 13 also shows how the rollers may be formed of roller segments 81. The segmented rollers are especially useful when dealing with driving fluids heavily loaded with particulates. If a piece of particulate matter becomes trapped between the roller and the stator wall, only the particular roller segment encountering the particulate matter will be pushed from its proper position of rolling along the stator wall. With the continuous rollers seen in previous figures, the entire roller tends to be pushed from the stator wall. These variations and all other similar variations are intended to come within the scope of the present invention. It is only necessary that the stator, flute, or roller segments be positioned within the housing in a manner to allow the invention to operate as described above. The size of the motor could vary greatly, from a ¾ inch diameter housing (or smaller) to a 6 inch diameter housing (or larger). Nor is the invention limited in the type of fluids which may be used to drive the motor. For example, smaller diameter motors are more likely (but not necessarily) to be run on water or oil, while larger diameter motors are more likely to be run on drilling mud or other fluids. Additionally, the definition of "fluids" includes gases and motor 1 could run on a pressurized gas such as compressed air or other compressed gases if a particular application so required. Nor is the invention limited to use in well drilling operations, but could be employed in any number of environments where torque is required and there is a source of pressurized fluid. For example, motor 1 could be used to power cleaning or obstruction removing equipment in wastewater lines or other lines. However, nothing in the foregoing description is intended to limit the scope of the invention to use in enclosed lines. The motor of the present invention could be used either by itself or in combination with other machinery in any industrial or mechanical environment conceivable. While the housing in FIG. 2 is round and the housing in FIG. 9 square, it can be seen how the housing could take any shape needed for a particular application. This is particularly easy to accomplish when the housing is constructed in sections as seen in FIG. 9. All such variations and modifications are intended to come within the scope of the following claims.

We claim:

1. A roller vane motor comprising:

a. a housing having an exhaust port;

b. an inlet header and an outlet header formed through at least a portion of said housing;

c. a first stator stage positioned within said housing, said first stator stage having an internal wall with an inlet port communicating through said wall to said inlet header and an outlet port communicating through said wall to said outlet header;

d. a second stator stage positioned within said housing, said second stator stage having an internal wall with an inlet port communicating through said wall to said inlet header and an outlet port communicating through said wall to said exhaust port of said housing;

e. a rotor assembly positioned within said stator stages, said rotor assembly having:

i) a rotor shaft with an aperture formed therethrough, ii) a plurality of flutes extending from said rotor tube; and f. rollers position between said flutes.

2. A roller vane motor according to claim 1, wherein said stator walls have a maximum radius and a minimum radius and said flutes have a radial dimension less than said minimum radius such that said flutes do not contact said stator walls at said minimum radius.

3. A roller vane motor according to claim 1, wherein said flutes have a run along said rotor tube and said rotor tube is a solid surface along said run of said flutes.

4. A roller vane motor according to claim 1, wherein a portion of said stators' internal walls at said outlet ports taper open at an angle of less than 45 degrees relative to a tangent of said internal wall at said outlet port.

5. A roller vane motor according to claim 4, wherein said exhaust port tapers open at an angle of less than 45 degrees relative to a tangent of said internal walls.

6. A roller vane motor according to claim 5, wherein said rollers have a roller radius and a clearance distance is formed between said flute and said maximum radius, said clearance distance being no greater than said roller radius.

7. A roller vane motor according to claim 1, wherein said internal walls have a back-seal arc, a inlet transition contour, a working-seal arc, and an outlet transition contour.

8. A roller vane motor according to claim 7, wherein said back-seal arc has a radius equal to said minimum radius and said working-seal arc has a radius equal to said maximum radius.

9. A roller vane motor according to claim 7, further including a flute tip circular pitch formed between adjacent flutes and wherein said back-seal arc and said working-seal arc have a length greater than or equal to said flute tip circular pitch.

10. A roller vane motor according to claim 9, wherein said working-seal arc has a length greater than approximately 1.3 times said flute tip circular pitch.

11. A roller vane motor according to claim 10, wherein said working-seal arc has a length between approximately 1.3 and approximately 1.5 times said flute tip circular pitch.

12. A roller vane motor according to claim 10, wherein said working-seal arc has a length greater than or equal to 1.5 times the length of said flute arc.

13. A roller vane motor according to claim 1, wherein said stator stages are formed of separate stator cylinders, said stator cylinders being insertable into an interior space formed in said housing.

14. A roller vane motor according to claim 13, wherein said stator cylinder further comprises a series of separately formed stator sections connected together to form said stator cylinder.

15. A roller vane motor according to claim 14, wherein each of said stator sections have an inlet and an outlet port formed therein.

16. A roller vane motor according to claim 15, wherein each of said stator sections include an internal wall where a portion of said internal wall at said outlet port tapers open at an angle of less than 45 degrees relative to a tangent of said internal wall at said outlet port.

17. A roller vane motor according to claim 1, wherein said stator stages are formed integrally with said housing.

18. A roller vane motor according to claim 17, wherein said housing is formed of housing sections and said internal walls of said stator stages are integrally formed on said housing sections.

19. A roller vane motor according to claim 18, wherein said internal walls on each of said housing sections have an inlet port and an outlet port formed therein.

20. A roller vane motor according to claim 19, wherein a portion of said internal wall in each of said housing sections at said outlet port tapers open at an angle of less than 45 degrees relative to a tangent of said internal wall at said outlet port.

21. A roller vane motor according to claim 1, wherein said flutes are formed in at least two separate segments.

22. A roller vane motor according to claim 21, wherein said rollers are formed in at least two segments.

* * * * *